US010697040B2

(12) United States Patent
Yan et al.

(10) Patent No.: US 10,697,040 B2
(45) Date of Patent: Jun. 30, 2020

(54) CONTINUOUS ANNEALING METHOD FOR LOW COERCIVE FORCE COLD-ROLLED ELECTROMAGNETIC PURE IRON PLATE AND STRIP

(71) Applicant: BAOSHAN IRON & STEEL CO., LTD., Shanghai (CN)

(72) Inventors: Yuanyuan Yan, Shanghai (CN); Gaofei Liang, Shanghai (CN); Guoping Cheng, Shanghai (CN); Changqing Lin, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 190 days.

(21) Appl. No.: 15/762,623

(22) PCT Filed: Sep. 1, 2016

(86) PCT No.: PCT/CN2016/099566
§ 371 (c)(1),
(2) Date: Mar. 23, 2018

(87) PCT Pub. No.: WO2017/054665
PCT Pub. Date: Apr. 6, 2017

(65) Prior Publication Data

US 2018/0265945 A1 Sep. 20, 2018

(30) Foreign Application Priority Data

Sep. 28, 2015 (CN) ..... 2015 1 0624002

(51) Int. Cl.

| | |
|---|---|
| ***C21D 9/52*** | (2006.01) |
| ***C22C 38/04*** | (2006.01) |
| ***C21D 8/12*** | (2006.01) |
| ***C21D 9/56*** | (2006.01) |
| ***C22C 38/00*** | (2006.01) |
| ***C22C 38/02*** | (2006.01) |
| ***C22C 38/06*** | (2006.01) |
| *C21D 1/26* | (2006.01) |
| *C21D 1/74* | (2006.01) |

(52) U.S. Cl.
CPC ..... *C21D 9/52* (2013.01); *C21D 8/12* (2013.01); *C21D 8/1244* (2013.01); *C21D 8/1261* (2013.01); *C21D 8/1272* (2013.01); *C21D 9/561* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C21D 1/26* (2013.01); *C21D 1/74* (2013.01)

(58) Field of Classification Search
CPC ..... C21D 9/00; C21D 9/52
USPC ..... 148/121
See application file for complete search history.

(56) References Cited

U.S. PATENT DOCUMENTS

| | | | | |
|---|---|---|---|---|
| 3,239,390 A * | 3/1966 | Kameo | C21D 8/0457 | 148/629 |
| 3,256,119 A * | 6/1966 | Logan et al. | C21D 9/52 | 148/558 |
| 3,351,501 A * | 11/1967 | Aspden | C21D 1/74 | 148/112 |
| 4,265,683 A | 5/1981 | Blaugher et al. | | |
| 4,315,783 A * | 2/1982 | Akisue | C21D 8/0426 | 148/603 |
| 4,398,700 A * | 8/1983 | Thorne | C21D 9/573 | 266/102 |

(Continued)

FOREIGN PATENT DOCUMENTS

| | | |
|---|---|---|
| CN | 1410580 A | 4/2003 |
| CN | 103205548 A | 7/2013 |

(Continued)

OTHER PUBLICATIONS

Wang, Hong-bin, et al, Effect of the Continuous Annealing Process on Microstructure and Mechanical Properties of DP590 Steel, (2013), Applied Mechanics and Materials, vols. 395-396, pp. 313-317, Trans Tech Publications. (Year: 2013).*

(Continued)

*Primary Examiner* — Melvin C. Mayes
*Assistant Examiner* — Danielle M. Carda
(74) *Attorney, Agent, or Firm* — Neal, Gerber & Eisenberg LLP

(57) ABSTRACT

A continuous annealing method for low coercive force cold-rolled electromagnetic pure iron plate and strip. Control parameters of each stages in a continuous annealing process are as follows: 750-850° C. at a heating stage; 750-850° C. at a soaking stage, the soaking time is 100-150 s; an outlet temperature of 575-675° C. at a slow-cooling stage, the cooling speed in slow-cooling stage is 2.5-10° C./s; an outlet temperature of 380-420° C. at a fast-cooling stage, the cooling speed of the fast-cooling stage is 15-25° C./s; and 270-310° C. at an overaging stage. The annealing medium is a non-oxidizing atmosphere composed of $H_2$ and $N_2$. After annealing, the cold-rolled electromagnetic pure iron plate and strip is leveled and pressed such that the leveling elongation rate of the plate and strip is controlled within the range of 0.2±0.1%. The process of the continuous annealing method is simple, and the produced cold-rolled electromagnetic pure iron plate and strip can achieve an overall performance of low coercive force and good formability without further magnetic annealing.

5 Claims, No Drawings

(56) References Cited

U.S. PATENT DOCUMENTS

| | | | | |
|---|---|---|---|---|
| 5,137,586 | A * | 8/1992 | Klink | C21D 1/767<br>148/529 |
| 5,497,817 | A * | 3/1996 | Ikegami | C21D 9/563<br>148/500 |
| 8,075,836 | B2 * | 12/2011 | Okada | C21D 8/0463<br>266/252 |

FOREIGN PATENT DOCUMENTS

| | | | | |
|---|---|---|---|---|
| EP | 2684975 | A1 * | 1/2014 | C21D 8/0273 |
| JP | H04301053 | A | 10/1992 | |

OTHER PUBLICATIONS

EP-2684975-A1 Translation (Year: 2019).*
Xie, Zhenya., "Effect of Cold-Rolling Deformation and Heat Treatment Process on Coercive Force of Magnetic Pure Iron," Special Steel, 2010, vol. 31(5), 5 pages.

* cited by examiner

CONTINUOUS ANNEALING METHOD FOR LOW COERCIVE FORCE COLD-ROLLED ELECTROMAGNETIC PURE IRON PLATE AND STRIP

CROSS-REFERENCE TO RELATED APPLICATION

This application is a national stage entry pursuant to 35 U.S.C. § 371 of International Application No. PCT/CN2016/099566, filed on Sep. 1, 2016, which claims priority to Chinese Patent Application No. 201510624002.2, filed on Sep. 28, 2015, the contents of all of which are fully incorporated herein by reference.

TECHNICAL FIELD

The invention relates to the field of metal material processing, particularly relates to a continuous annealing method for cold-rolled electromagnetic pure iron plate and strip (pure iron sheet strip) of low coercive force, high formability, without further magnetic annealing.

BACKGROUND ART

The electromagnetic pure iron has characteristics of low coercive force, high magnetic permeability and excellent processing performance, and is an important functional soft magnetic material.

Traditional electromagnetic iron products are dispatched from factories in a softened annealed state. Only after these pure iron products are stamped into parts and magnetic annealed by the users to eliminate the lattice distortion of cold processing, the products can thus fully show magnetic properties. According to the national standard GB/T 6983-2008, the cold-rolled electromagnetic pure iron steel can be divided into four grades on the basis of the magnetic properties, from high to low: DT4(Hc≤96 A/m), DT4A (Hc≤72 A/m), DT4E(Hc≤48 A/m), DT4C(Hc≤32 A/m). In addition, the magnetic annealing process of electromagnetic pure iron are stipulated as follows: when the annealing is protected by vacuum or inert gases, the electromagnetic pure iron is heated to a temperature of 900±10° C. with the furnace and kept for 1 h, and then the electromagnetic pure iron is cooled to 500° C. or less or room temperature at a cooling rate of less than 50° C./h and then discharged from the furnace; when annealing in a decarburization atmosphere, the electromagnetic pure iron is heated to 800° C. with the furnace, and then heated to 900±10° C. in no less than 2 h and kept for 4 h, and then the electromagnetic pure iron is cooled to 500° C. or less or room temperature at a cooling rate of less than 50° C./h and then discharged from the furnace.

An important application of the cold-rolled electromagnetic pure iron sheet strip is magnetic shielding materials, such as magnetic shell of electrical relay. In the conventional process, the parts are stamped and formed, and then magnetic annealed for up to several hours, the problem is that the magnetic shell parts are always large, which adds extra requirements for annealing equipment, the production capacity is usually limited by the furnace loading capacity, and thereby prone to resulting in making the magnetic annealing process become a bottleneck in the entire production process, which extends the product manufacturing and processing cycle, and increases the cost thereof. Therefore, the manufacturers hope to use the electromagnetic pure iron sheet strip having low coercive force (<100 A/m) and high formability, and does not require further magnetic annealing, but the prior art has not yet reached this target.

Analysis of existing patents related to electromagnetic pure iron products is shown in Table 1. First of all, most of the patents are focused on the continuous improvement of magnetic properties of cold-rolled electromagnetic pure iron, wherein the magnetic properties of the material is improved through the adjustment of alloy composition, the optimization of hot-rolled and cold-rolled process, and the control of magnetic annealing stages. The patent CN103789609A claims a method of improving the purity of electromagnetic pure iron, wherein the impurity element is reduced by electroslag remelting of forging ingot. Patent CN104232856A is directed to the problem that the surface of the workpiece may be easily oxidized during the magnetic annealing process, wherein an improvement method of magnetic annealing the electromagnetic pure iron parts is proposed.

TABLE 1

Analysis of related patents of electromagnetic pure iron products

| Publication Number | Alloy Composition | Hot-Rolled Process | Cold-Rolled Process | Annealing Process | Products |
|---|---|---|---|---|---|
| CN1211625A | Low Al | Heating 1100-1250° C. Final rolling 850-950° C. Reeling 600-750° C. | — | Cover annealing 580° C. and kept for 5 h; Magnetic annealing 850-910° C. and kept for 4 h | DT4E cold-rolled sheet |
| CN1410580 | Low Al | Heating 1000-1250° C. Final rolling 750-900° C. | Deformation >60% | Continuous annealing 600-800° C., Magnetic annealing 800-900° C. and kept for 2 h | DT4E cold-rolled sheet |
| CN1775466 | High Al | Final rolling 830-890° C. Reeling 680-750° C. | Deformation 30-50% | Magnetic annealing 900-980° C. and kept for 3-5 h | DT4C cold-rolled sheet |
| CN103205548A | High Al | Final rolling 860-1000° C. Reeling 700-800° C. | Deformation 30-40% | Cover annealing 540-560° C. and kept for 6-8 h; Magnetic annealing 1000-1100° C. and kept for >2 h | DT4C cold-rolled sheet |

TABLE 1-continued

| Analysis of related patents of electromagnetic pure iron products | | |
|---|---|---|
| Publication Number | Summary Of The Invention | Products |
| CN103789609A | High Al (electroslag remelting)→hot-rolled bar | Electromagnetic pure iron bar without hair seam |
| CN104232856A | magnetic annealing process of the formed parts: 850-900° C., kept for 3-4 h, protect with alumina powder to prevent oxidation | Annealing method |

SUMMARY OF THE INVENTION

The purpose of the present invention is to provide a continuous annealing method for low coercive force cold-rolled electromagnetic pure iron sheet strip. The process of the continuous annealing method is simple, and the produced cold-rolled electromagnetic pure iron sheet strip can achieve an overall performance of low coercive force and good formability without further magnetic annealing.

In order to achieve the above technical purpose, the present invention has the following technical solutions:

A continuous annealing method for low coercive force cold-rolled electromagnetic pure iron sheet strip, wherein the parameters of each stages in a continuous annealing furnace are controlled as follows: 750-850° C. at a heating stage; 750-850° C. at a soaking stage, with a soaking time being 100-150 s; an outlet temperature of 575-675° C. at a slow-cooling stage, with a cooling speed in slow-cooling stage being 2.5-10° C./s; an outlet temperature of 380-420° C. at a fast-cooling stage, with a cooling speed of the fast-cooling stage being 15-25° C./s; and 270-310° C. at an overaging stage. An annealing medium is a non-oxidizing atmosphere composed of $H_2$ and $N_2$. After annealing, the cold-rolled electromagnetic pure iron sheet strip is leveled and pressed such that a leveling elongation rate of the sheet strip is controlled within a range of 0.2±0.1%.

The thickness of the cold-rolled electromagnetic pure iron sheet strip is 0.5-3.0 mm.

Further, the percent composition by mass of the elements of the cold-rolled electromagnetic pure iron sheet strip are: C≤0.005%, Si≤0.1%, Mn=0.1%~0.5%, P≤0.02%, S≤0.003%, Al≤0.005% or Al=0.1~1.5%, B≤0.007%, [N]≤0.005%, [O]≤0.02%, and the rest is Fe and unavoidable impurities.

Further, the as-described cold-rolled electromagnetic pure iron sheet strip after annealing has a coercive force of 60-100 A/m, a yield strength of not less than 120 MPa, an elongation of not less than 35%.

Further, the hot-rolled processing parameters of the as-described cold-rolled electromagnetic pure iron sheet strip are: heating temperature of 1000~1200° C.; final rolling temperature of 750~900° C.; reeling temperature of 550~720° C.; cold-rolled reduction rate of within 30~55%.

The electromagnetic pure iron sheet strip prepared by the continuous annealing method in the present invention has the advantages of low coercive force, high formability without further magnetic annealing, and thus solves the following problems: the traditional cold-rolled electromagnetic pure iron material needs to be magnetic annealed after stamped into parts, while the magnetic annealing of large-size parts is limited by furnace loading capacity, additionally, the product manufacturing and processing cycle is long, and the cost is high.

The mechanism of the continuous annealing method for low coercive force cold-rolled electromagnetic pure iron sheet strip of present invention is as follows.

The low coercive force cold-rolled electromagnetic pure iron sheet strip of present invention is prepared by the continuous annealing method. Because of the large amount of lattice distortion in the ferrite grain caused by rolling process, a large movement resistance of magnetic domain exists in the lattice, high-temperature annealing can provide enough thermodynamic driving force for recrystallization to eliminate the lattice distortion of cold rolling. Furthermore, if the annealing time is too short, the crystalline grain growth is not sufficient and the coercive force of the material is not satisfactory. The soaking temperature for annealing is 750-850° C. and the time in soaking stage for annealing is 100-150 s, thus can ensure the production efficiency under the premise of coercive force Hc≤100 A/m of material.

The leveling elongation rate of the cold-rolled electromagnetic pure iron sheet strip of present invention should be controlled within the range of 0.2±0.1%. The increase of magnetic domain resistance due to the crystal defect resulted from leveling and pressing significantly affects the coercive force, however, due to the intrinsic low yield strength of the pure iron, the high-temperature continuous annealing is prone to result in edge wrinkles and other quality defects, and therefore, moderate leveling and pressing is also a key step to ensure the quality of the product surface; on the basis of above factors, the reduction rate is controlled to no more than 0.3%.

In this invention, the specific chemical composition of the electromagnetic pure iron sheet strip suitable for the above annealing method must satisfy certain requirements. C, N, O, and S are extremely detrimental elements to the magnetism of pure iron, and the distribution of fine MnS, AlN precipitates and oxide inclusions may hinder the grain growth, strongly affect the magnetization, and increase the coercive force. Therefore, when applying the annealing process of present invention, the content of impurity elements should be minimized as much as possible while avoiding the formation of fine inclusions. Aluminum significantly affects the existence form of inclusions in the pure iron. The control of aluminum usually takes the measure using two extreme values for the following reasons: acid soluble aluminum (Als) in the range of 0.005-0.014% is prone to form fine AlN and thus prevent the growth of ferrite grain, when there are too many fine grain being exist, the orientations which is detrimental to magnetic properties will dramatically increase. However, when Als≤0.003%, as the aluminum content is reduced, the grains are coarsening and the orientations which is beneficial to magnetic properties increased. When the content of aluminum is above 0.15%, coarse AlN can also be formed, which improves the texture and reduces the magnetic anisotropy, and fixes N so as to reduce the magnetic aging.

In addition, with respect to the selection of hot-rolled process, higher final rolling and reeling temperatures are selected for the following reasons: on the one hand, higher final rolling and reeling temperatures are beneficial to the recovery, recrystallization and grain growth of the deformed hot-rolled structure, and promote the formation of coarse grain in the hot-rolled plate; on the other hand, higher final rolling and reeling temperatures are beneficial to the aggregation and growth of fine inclusions (such as AlN, MnS) in the steel, thereby reducing the interference of fine inclusions on the grain boundary movement during the heat treatment of the sample, and thus reducing the pinning effect on the magnetic domain movement.

Cold-rolled reduction rate should be controlled at 30~55% and an excessive reduction rate should be avoid. During the cold-rolled process, different deformations will result in different deformed microstructures, which will affect nucleation and growth kinetics during the recrystallization. Low amount of cold-rolled deformation may introduce strain in the hot-rolled plate, and thereby induce grain boundary migration, promoting the growth of annealed grains and getting better magnetic properties. However, with the further increase of the amount of cold-rolled deformation, the complex slip regions increase, and cellular structure develops. Although both of the rates of recrystallization nucleation and grain growth increase, the nucleation rate will be greater than the grain growth rate, resulting in fine recrystallized grains, an increased corresponding coercive force He and worse magnetic properties.

The low coercive force cold-rolled electromagnetic pure iron sheet strip prepared by the continuous annealing method in present invention does not require further magnetic annealing. The index parameters of cold-rolled electromagnetic pure iron sheet strip after annealing are: a coercive force of 60-100 A/m, a yield strength 120 MPa, an a elongation≥35%.

As the last stage of the production of cold-rolled electromagnetic pure iron sheet strip, the continuous annealing method for low coercive force cold-rolled electromagnetic pure iron sheet strip of the present invention has a simple process, and the cold-rolled electromagnetic pure iron sheet strip produced can achieve an overall performance of low coercive force and good formability without further magnetic annealing.

DETAILED DESCRIPTION

Example 1

Components: the percent composition by mass of the elements of the strip steel is shown in Table 2, and the rest is Fe and unavoidable impurities. The strip thickness is 1.2±0.04 mm.

TABLE 2

The mass percentages of the chemical composition of the strip steel of Example 1 (unit: %)

| C | Si | Mn | P | S | Al | B | N | O |
|---|---|---|---|---|---|---|---|---|
| 0.0021 | 0.089 | 0.27 | 0.016 | 0.003 | 0.001 | 0.0001 | 0.002 | 0.018 |

Process: parameters in hot-rolled process: heating temperature 1150° C.; final rolling temperature 850° C.; reeling temperature 550° C.; cold-rolled reduction rate 50%.

The specific processing parameters according to the annealing method of present invention are: 830±20° C. at a heating stage; 830±20° C. at a soaking stage, the soaking time is 140 s; an outlet temperature of 675° C. at a slow-cooling stage, the cooling speed in slow-cooling stage is 5° C./s; an outlet temperature of 400° C. at a fast-cooling stage, the cooling speed of the fast-cooling stage is 25° C./s; and 300° C. at an overaging stage; the annealing medium is a non-oxidizing atmosphere composed of $H_2$ and $N_2$. The leveling elongation rate of the annealed sheet strip is controlled within the range of 0.2±0.1%.

Implementation results: coercive force He of continuous annealing of cold-rolled electromagnetic pure iron sheet strip: 71 A/m, yield strength: 159 Mpa, elongation: 53.5%. It has good overall performance.

Example 2

Components: the percent composition by mass of the elements of the strip steel is shown in Table 3, and the rest is Fe and unavoidable impurities. The strip thickness is 2.0±0.04 mm.

TABLE 3

The mass percentages of the chemical composition of the strip steel of Example 2 (unit: %)

| C | Si | Mn | P | S | Al | B | N | O |
|---|---|---|---|---|---|---|---|---|
| 0.0019 | 0.003 | 0.18 | 0.019 | 0.003 | 0.55 | 0.0001 | 0.0019 | 0.005 |

Process: parameters in hot-rolled process: heating temperature 1150° C.; final rolling temperature 870° C.; reeling temperature 650° C.; cold-rolled reduction rate 45%.

The specific processing parameters according to the annealing method of present invention are: 830±20° C. at a heating stage; 830±20° C. at a soaking stage, the soaking time is 130 s; an outlet temperature of 675° C. at a slow-cooling stage, the cooling speed in slow-cooling stage is 5° C./s; an outlet temperature of 400° C. at a fast-cooling stage, the cooling speed of the fast-cooling stage is 25° C./s; and 300° C. at an overaging stage; the annealing medium is a non-oxidizing atmosphere composed of $H_2$ and $N_2$. The leveling elongation rate of the annealed sheet strip is controlled within the range of 0.2±0.1%.

Implementation results: coercive force He of continuous annealing of cold-rolled electromagnetic pure iron sheet strip: 65 A/m, yield strength: 155 Mpa, elongation: 55%. It has a good overall performance.

Example 3

Components: the percent composition by mass of the elements of the strip steel is shown in Table 4, and the rest is Fe and unavoidable impurities. The strip thickness is 1.0±0.04 mm

TABLE 4

The mass percentages of the chemical composition of the strip steel of Example 3 (unit: %)

| C | Si | Mn | P | S | Al | B | N | O |
|---|---|---|---|---|---|---|---|---|
| 0.0023 | 0.003 | 0.18 | 0.016 | 0.0036 | 0.001 | 0.0052 | 0.0021 | 0.013 |

Process: parameters in hot-rolled process: heating temperature 1200° C.; final rolling temperature 900° C.; reeling temperature 720° C.; cold-rolled reduction rate 40%.

The specific processing parameters according to the annealing method of present invention are: 810±20° C. at a heating stage; 810±20° C. at a soaking stage, the soaking time is 110 s; an outlet temperature of 650° C. at a slow-cooling stage, the cooling speed in slow-cooling stage is 6° C./s; an outlet temperature of 400° C. at a fast-cooling stage, the cooling speed of the fast-cooling stage is 25° C./s; and 300° C. at an overaging stage; the annealing medium is a non-oxidizing atmosphere composed of $H_2$ and $N_2$. The leveling elongation rate of the annealed sheet strip is controlled within the range of 0.2±0.1%.

Implementation results: coercive force He of continuous annealing of cold-rolled electromagnetic pure iron sheet strip: 80 A/m, yield strength: 157 Mpa, elongation: 50.3%. It has a good overall performance.

Example 4

Components: the percent composition by mass of the elements of the strip steel is shown in Table 5, and the rest is Fe and unavoidable impurities. The strip thickness is 1.8±0.04 mm.

TABLE 5

The mass percentages of the chemical composition of the strip steel of Example 4 (unit: %)

| C | Si | Mn | P | S | Al | B | N | O |
|---|---|---|---|---|---|---|---|---|
| 0.0030 | 0.003 | 0.18 | 0.019 | 0.003 | 0.002 | 0.0001 | 0.0016 | 0.017 |

Process: parameters in hot-rolled process: heating temperature 1120° C.; final rolling temperature 870° C.; reeling temperature 700° C.; cold-rolled reduction rate 40%.

The specific processing parameters according to the annealing method of present invention are: 810±20° C. at a heating stage; 810±20° C. at a soaking stage, the soaking time is 130 s; an outlet temperature of 675° C. at a slow-cooling stage, the cooling speed in slow-cooling stage is 5° C./s; an outlet temperature of 400° C. at a fast-cooling stage, the cooling speed of the fast-cooling stage is 25° C./s; and 300° C. at an overaging stage; the annealing medium is a non-oxidizing atmosphere composed of $H_2$ and $N_2$. The leveling elongation rate of the annealed sheet strip is controlled within the range of 0.2±0.1%.

Implementation results: coercive force He of continuous annealing of cold-rolled electromagnetic pure iron sheet strip: 84 A/m, yield strength: 165 Mpa, elongation: 52%. It has a good overall performance.

Comparative Example

Components: the percent composition by mass of the elements of the strip steel is shown in Table 6, and the rest is Fe and unavoidable impurities. The strip thickness is 1.8±0.04 mm.

TABLE 6

The mass percentages of the chemical composition of the strip steel of Comparative example

| C | Si | Mn | P | S | Al | B | N | O |
|---|---|---|---|---|---|---|---|---|
| 0.0030 | 0.003 | 0.18 | 0.019 | 0.003 | 0.002 | 0.0001 | 0.0016 | 0.017 |

Process: parameters in hot-rolled process: heating temperature 1120° C.; final rolling temperature 870° C.; reeling temperature 700° C.; cold-rolled reduction rate 40%.

Annealing method: 560±20° C. at a heating stage; 560±20° C. at a soaking stage, the soaking time is 100 s; an outlet temperature of 500° C. at a slow-cooling stage, the cooling speed in slow-cooling stage is 5° C./s; an outlet temperature of 370° C. at a fast-cooling stage, the cooling speed of the fast-cooling stage is 25° C./s; and 280° C. at an overaging stage; the annealing medium is a non-oxidizing atmosphere composed of $H_2$ and $N_2$. The leveling elongation rate of the annealed sheet strip is controlled within the range of 1.0±0.2%.

Implementation results: coercive force He of continuous annealing of cold-rolled electromagnetic pure iron sheet strip: 127 A/m, yield strength: 213 Mpa, elongation: 42%. The final products have an over-high coercive force, which cannot meet the requirements of the use of magnetic shielding materials.

The invention claimed is:

1. A continuous annealing method for low coercive force cold-rolled electromagnetic pure iron sheet, wherein control parameters of each stage in a continuous annealing process are as follows: 750-850° C. at a heating stage; 750-850° C. at a soaking stage, with a soaking time being 100-150 s; an outlet temperature of 575-675° C. at a slow-cooling stage, with a cooling speed in the slow-cooling stage being 2.5-10° C./s; an outlet temperature of 380-420° C. at a fast-cooling stage, with a cooling speed of the fast-cooling stage being 15-25° C./s; and 270-310° C. at an overaging stage; an annealing medium is a non-oxidizing atmosphere composed of $H_2$ and $N_2$; after annealing, the cold-rolled electromagnetic pure iron sheet strip is leveled and pressed such that a leveling elongation rate of the sheet strip is controlled within a range of 0.2±0.1%.

2. The continuous annealing method for low coercive force cold-rolled electromagnetic pure iron sheet strip according to claim 1, wherein a thickness of the said cold-rolled electromagnetic pure iron sheet strip is 0.5-3.0 mm.

3. The continuous annealing method for low coercive force cold-rolled electromagnetic pure iron sheet strip according to claim 1, wherein a percent composition by mass of the elements of the said cold-rolled electromagnetic pure iron sheet strip is: C≤0.005%, Si≤0.1%, Mn=0.1-0.5%, P≤0.02%, S≤0.003%, Al≤0.005% or Al=0.1-1.5%, B≤0.007%, [N]≤0.005%, [O]≤0.02%, and the rest is Fe and unavoidable impurities.

4. The continuous annealing method for low coercive force cold-rolled electromagnetic pure iron sheet strip according to claim 3, wherein the said cold-rolled electromagnetic pure iron sheet strip after annealing has a coercive force of 60-100 A/m, a yield strength of not less than 120 MPa, a elongation of not less than 35%.

5. The continuous annealing method for low coercive force cold-rolled electromagnetic pure iron sheet strip according to claim 3, wherein hot-rolled processing parameters of the said cold-rolled electromagnetic pure iron sheet strip are: heating temperature of 1000-1200° C.; final rolling temperature of 750-900° C.; reeling temperature of 550-720° C.; cold-rolled reduction rate of within 30-55%.

* * * * *